US005549410A

United States Patent [19]

Beryozkin et al.

[11] Patent Number: 5,549,410

[45] Date of Patent: Aug. 27, 1996

[54] PORTABLE VEHICLE BARRIER

[76] Inventors: Vladimir Beryozkin, 3 Stephen Ct., New City, N.Y. 10956; Alexander Rudshteyn, 2060 Ocean Ave., #6A, Brooklyn, N.Y. 11235

[21] Appl. No.: 314,783

[22] Filed: Sep. 29, 1994

[51] Int. Cl.[6] ..... E01F 13/00

[52] U.S. Cl. ..... 404/6; 49/33

[58] Field of Search ..... 404/6, 9; 49/33

[56] References Cited

U.S. PATENT DOCUMENTS 4,828,424 5/1989 Crisp, Sr. ..... 404/6

4,850,737 7/1989 Nasatka et al. ..... 404/6

*Primary Examiner*—William P. Neuder

*Attorney, Agent, or Firm*—Ilya Zborovsky

[57] ABSTRACT

A vehicle barrier for preventing unauthorized entry of a vehicle to a designated area comprises a frame, penetrating means mounted on the frame and engageable into a ground so as to prevent movement of the barrier upon impact by an unauthorized vehicle; means for puncturing tires of an unauthorized vehicle provided on the frame, means arresting the unauthorized vehicle on the frame when the vehicle enters the barrier, and means for allowing the frame to move on a road surface so that the barrier can be installed at the desired location.

9 Claims, 2 Drawing Sheets

PORTABLE VEHICLE BARRIER

BACKGROUND OF THE INVENTION

The present invention relates to devices for denying access of unauthorized vehicles to secure, protected areas, compounds, ground and multi-level garages, parking lots, rental car facilities, etc.

Devices of the above mentioned general type are known in the art. However, the majority of these devices require permanent installation for permanent traffic control and rely on their weight, size and mass to dissipate kinetic energy of a car bomb and the like. The known devices are very heavy and require handling equipment for deployment and redeployment. These devices can be subdivided into passive devices which do not have to be activated in any way and cannot be used for temporary control of traffic and active devices which require actions by personnel or equipment to deploy and therefore permit selective entry. Active barriers normally require a power source for their operation and are activated automatically by sensors or manually by sentries or security personnel using remote switches.

A passive vehicle barrier system has some disadvantages. In particular, it requires a lot of time to set it into position and cannot be used for selective vehicle access. A greater need has been identified in the last years in the area of temporary traffic control than in the area of permanent traffic control. As a result, man portable vehicle barriers became available for use so that they can be deployed and taken away on a short notice by a few people. Examples of such barriers are erectable fences, steel cable barriers, wire jacks, etc.

U.S. Pat. No. 4,824,282 discloses a quickly erectable vehicle barrier for use across a roadway, with the utilization of large massive and bulky frame with the apparatus for inflation of an air bag and spreading the net across the vehicle. U.S. Pat. Nos. 4,818,137, 4,923,327 and 4,759,655 disclose a terrorist vehicle arresting system which has a turnstile with a sector for deflection of a terrorist vehicle into a crash barrier, and also a nut for a vehicle entrapment. U.S. Pat. No. 4,780,020 discloses a terrorist vehicle barrier which has at least two upright supports and a cable means to provide a barrier between the supports, as well as a shock absorbing block. Finally, U.S. Pat. No. 3,471,130 discloses a road block apparatus adapted to assist officers of the law to pursue or capture drivers of stolen or get-away cars, which has a rupture-resisting plastic sheet panel suspended between a pair opposed posts, and a rope.

The above mentioned devices require a lot of time for installation, they cannot be transported and installed just by two people, they are not mobile, they can be easily crashed by a vehicle intruder, they are designed only for roadways, most of them cannot be installed on a very short notice, and they cannot prevent penetration of vehicle intruder in security zones.

SUMMARY OF THE INVENTION

Accordingly, it is an object of the present invention to provide a vehicle barrier which avoids the disadvantages of the prior art.

More particularly, it is an object of the present invention to provide a vehicle barrier which is mobile, portable, has a simple construction, is highly efficient, inexpensive, which also has a light weight, can be produced with low cost and has a relatively small size.

In keeping with these objects and with others which will become apparent hereinafter, one feature of the present invention resides, briefly stated, in a vehicle barrier which has a frame, penetrating means mounted on the frame and engageable into a ground so as to prevent movement of the barrier upon impact by an unauthorized vehicle; means for puncturing tires of an unauthorized vehicle provided on the frame, means arresting the unauthorized vehicle on the frame when the vehicle enters the barrier, and means for allowing the frame to move on a road surface so that the barrier can be installed at the desired location.

When the vehicle barrier is designed in accordance with the present invention, it eliminates the disadvantages of the prior art and provides for the above mentioned highly advantageous results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 is a view showing the inventive vehicle barrier of FIG. 1 in a working position; and FIG. 5 shows a vehicle arresting system of the inventive portable vehicle barrier of FIG. 1.

DESCRIPTION OF THE PREFERRED EMBODIMENTS

Figure 1:
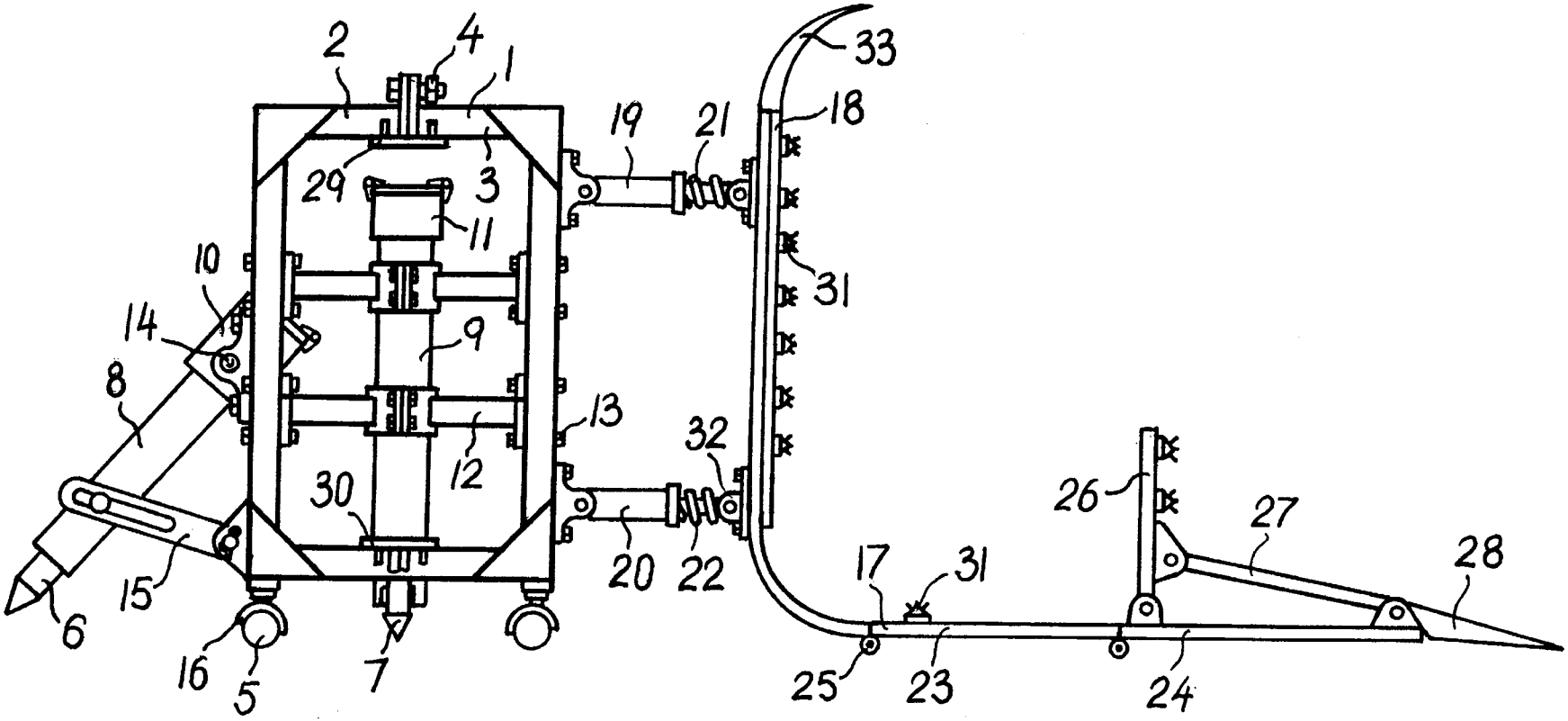
FIG. 1 is a view showing a vehicle barrier in accordance with the present invention.

A vehicle barrier shown in FIG. 1 has a frame which is identified as a whole with reference numeral 1 and composed of frame units 2 and 3 which are easy to assemble. The units 2 and 3 are connected with one another by fingers 4. Four wheels 5 are provided on the frame 1. For holding the barrier in a stationary position during an impact of a vehicle-intruder, stoppers 6 and 7 are further provided. The stoppers are movable by cylinders 8 and 9. The cylinder 9 is mounted inside the frame by internal supports 12 and fingers 13. The cylinder 8 is attached to the frame 1 by a joint 14 and a link 15. The joint 14 and the link 15 are adjustable elements which provide the movement of the cylinder 8 to its vertical and horizontal positions and also provide a proper angle for the stops 6 to enter and penetrate the ground or road surface. The cylinders 8 and 9 are also provided with chambers 10 and 11 for mounting of power units.

The barrier has friction type stop brakes 16 installed on the wheels 5. It also has a horizontal platform 17 and a vertical platform 18 with a dismountable spherical end 33. The vertical platform 18 is connected with the frame 1 by upper and lower shock absorbers 19 and 20, shock absorber springs 21 and 22, correspondingly, and a shock absorber support 32. The horizontal platform 17 has a variable length and includes two or several elements 23 and 24 connectable with one another by fingers 25. The platform 17 is provided with a turnable buffer 26 connected by a link 27 to a prop-stop 28 for arresting the vehicle Thereby when a vehicle moves over the horizontal platform 17 toward the vertical platform 18, it turns the buffer 26 to a horizontal position and the buffer through the link 17, turns the prop-stop 28 to a substantially upright or angular position shown in FIG. 4. Therefore the vehicle cannot move back from the horizontal platform. Finally, locking devices 27 and 28 are provided for easy and fast assembly of the elements. Each platform also has vehicle tire punctuators 31.

The vehicle barrier in accordance with the present invention operates in the following manner. The barrier can be delivered to a site of use and easily assembled and erected. After assembly and erection as well as installation of power units, the stops 6 and 7 are activated for example by a radio, motion or light detector or a timer, and the brakes 16 are applied. When a vehicle-intruder approaches the barrier the headlights of the vehicle, or a radio signal from a sentry, from a motion detection, from a timer, etc., activates the power devices and the stoppers 5 and 6 penetrate the ground of the road surface. After the vehicle strikes against the vertical platform 18 without explosion, the kinetic energy of the impact will dissipate due to the absorption by shock absorbers of the barrier. The vehicle also will be dropped on the horizontal platform between the vertical platform and prop-stop and will not be able to move from the horizontal platform.

Figure 2:
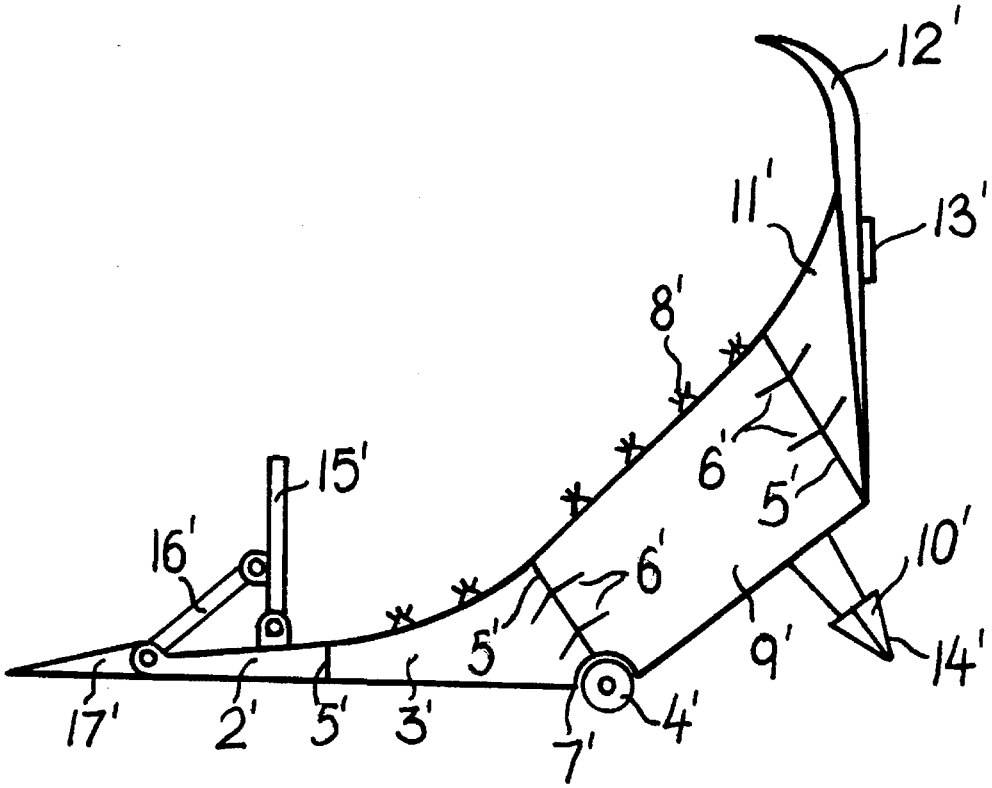
FIG. 2 is a view showing an inventive vehicle barrier in accordance with a further embodiment of the invention.

The vehicle barrier shown in FIG. 2 is identified with reference numeral 1' and has a barrier step 2', a barrier hill 3', two wheels 4', reinforcing ribs 5', stiffeners 6', wheel brakes 7', vehicle tire punctuators 8', a main section 9', two ground or surface penetrates 10', an upper part 11', an end part 12', a handle 13', an end penetrator portion 14', a buffer 15', a buffer link 16', and a prop-stop 17'.

This barriers operates in the following manner.

The internal surface of the barrier resembles a curve assembled from different units and capable of projecting the vehicle tires and the vehicle to the top and deflecting them back to the step 2'. In order to prevent the barrier from moving during the vehicle impact, the barrier is provided with the above mentioned ground or surface penetrators 10' which have the superhard end portions 14', and also with the wheel stop brakes 7'. When the vehicle-intruder wheels roll on the internal surface of the barrier, they will be destroyed by the tire punctuators 8' and deflected by to the step 2'. When the vehicle starts moving on the main part 9' of the barrier, the impact will occur between the barrier and the vehicle and due to the impact the barrier will rock down to the ground with high speed. The powerful force created by the impact will push the stoppers 10' to enter the ground with a tremendous force and speed and penetrate any type of the surface and therefore stop the barrier from moving. The prop-stop 17' will stop the vehicle from breaking off from the barrier.

Figure 3:
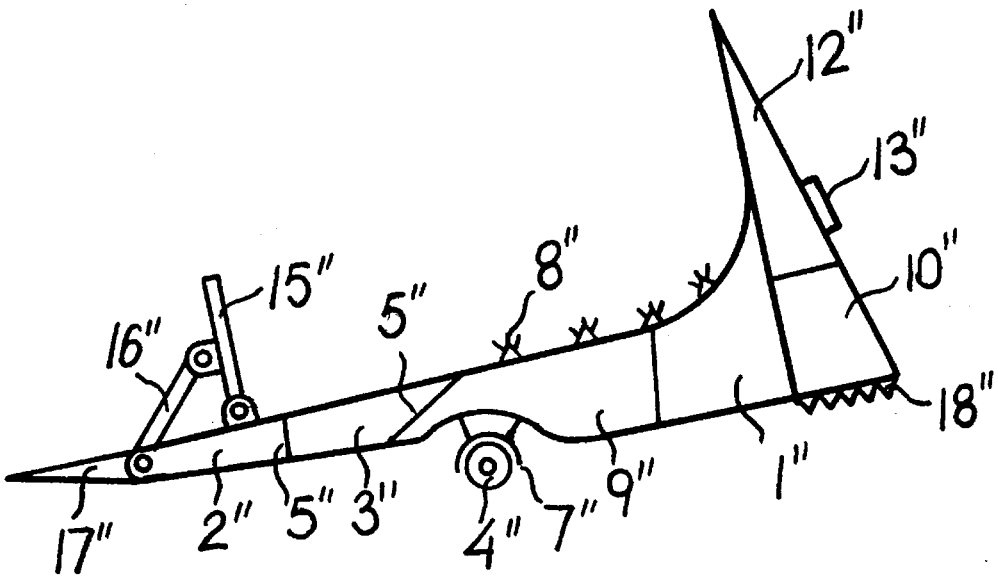
FIG. 3 is a view showing the inventive vehicle barrier in accordance with still a further embodiment.

In the vehicle barrier in the embodiment of FIG. 3, the parts which are similar to the parts of FIG. 2 are identified with the same reference numerals with the addition of ". In this construction, instead of the hip-shaped penetrators, a plurality of teeth 18" are provided on the lower surface of an end part 10" of the barrier. Also, the upper surface of the main part of the barrier is straight, while the surface of the end part extends substantially vertically with a small radius therebetween. Here again, upon turning of the barrier the teeth 18" penetrate into any ground surface to prevent the barrier from moving.

It will be understood that each of the elements described above, or two or more together, may also find a useful application in other types of constructions differing from the types described above.

While the invention has been illustrated and described as embodied in a portable vehicle barrier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A vehicle barrier for preventing unauthorized entry of a vehicle to a designated area, comprising a frame; penetrating means mounted on said frame and engageable into a ground so as to prevent movement of the barrier upon impact by an unauthorized vehicle; means for puncturing tires of an unauthorized vehicle provided on said frame; means arresting the unauthorized vehicle on the frame when the vehicle enters the barrier; and means for allowing said frame to move on a road surface so that the barrier can be installed at the desired location.

2. A vehicle barrier as defined in claim 1, wherein said means for penetrating the ground are formed as substantially sharp elements mounted on the frame and engageable in the ground.

3. A vehicle barrier as defined in claim 2; and further comprising means for displacing said sharp elements from the frame so as to engage said sharp elements into ground.

4. A vehicle barrier as defined in claim 2, wherein said frame is tiltable under the action of impact by the unauthorized vehicle so that upon tilting said elements engage into the ground under the action of the impact.

5. A vehicle barrier as defined in claim 2, wherein said engaging elements are formed by a plurality of teeth.

6. A vehicle barrier as defined in claim 2, wherein said engaging elements are formed by a plurality of tipped members with hardened ends.

7. A vehicle barrier as defined in claim 1, wherein said retaining means include a projecting formation mounted on said frame so that when the unauthorized vehicle enters said frame it cannot move backwards being stopped by said formation.

8. A vehicle barrier as defined in claim 1, wherein said piercing means include a plurality of sharp elements arranged on an outer surface of said frame.

9. A vehicle barrier as defined in claim 1; and further comprising means for absorbing an impact by the unauthorized vehicle and including absorbing elements located between parts of said frame.

* * * * *